United States Patent [19]

Otting et al.

[11] Patent Number: 4,578,836

[45] Date of Patent: Apr. 1, 1986

[54] METHOD OF DYEING CARPET

[75] Inventors: David L. Otting; Billy J. Otting, both of LaFayette, Ga.

[73] Assignee: Otting International, Inc., LaFayette, Ga.

[21] Appl. No.: 660,725

[22] Filed: Oct. 15, 1984

Related U.S. Application Data

[63] Continuation-in-part of Ser. No. 585,439, Mar. 2, 1984, and a continuation-in-part of Ser. No. 608,944, May 10, 1984.

[51] Int. Cl.[4] ..... D06B 1/02; D06B 21/00

[52] U.S. Cl. ..... 8/151; 8/158; 8/485; 8/929; 8/932; 68/205 R

[58] Field of Search ..... 8/151, 158, 929, 930, 8/483, 485, 499, 932, 934; 68/62, 205 R

[56] References Cited

U.S. PATENT DOCUMENTS

| | | | |
|---|---|---|---|
| 3,523,749 | 8/1970 | MacLeod | 8/929 X |
| 4,361,019 | 11/1982 | Maund | 68/62 |

FOREIGN PATENT DOCUMENTS

| | | | |
|---|---|---|---|
| 2009257 | 9/1971 | Fed. Rep. of Germany | 8/483 |
| 1241820 | 8/1971 | United Kingdom . | |
| 1479884 | 7/1977 | United Kingdom | 8/929 |

*Primary Examiner*—Philip R. Coe
*Attorney, Agent, or Firm*—Alan Ruderman

[57] ABSTRACT

The method of dyeing a continuously moving carpet pile fabric with a heated base color dye and either thereafter applying other color dyes onto the base color or applying the other color dyes prior to the base color, all of the dyes being fixed by the heat of the base color dye and without the use of steam. The dyeing process employs a dye applicator to which is heated dye solution is supplied and this dye is sprayed onto the carpet while at a temperature of approximately 185° F. to 205° F. to provide the base color. The base color dye is applied with a wet pick-up of approximately 200 percent to 300 percent. The other color dyes, which are pattern colors, at substantially ambient temperatures are independently sprayed onto the carpet at spaced locations either before the heated dye is applied or subsequent to the hot dye while the carpet is still in the temperature range of approximately 165° F. to 175° F. The total amount of pattern color dye applied to the carpet provides a wet pick-up of approximately 120 percent. The base color dye is fixed substantially instantly, and each of the other dyes are fixed substantially on contact with the heated dye.

22 Claims, 2 Drawing Figures

METHOD OF DYEING CARPET

BACKGROUND OF THE INVENTION

This application is a continuation-in-part of our copending U.S. application Ser. No. 585,439, filed Mar. 2, 1984, and a continuation-in-part or our copending U.S. application Ser. No. 608,944 filed May 10, 1984.

This invention relates to the finish treatment of pile fabric such as carpet and more particularly to a method of dyeing the carpet by first applying a base color and thereafter applying other colors to the carpet or first applying the other colors separately to the carpet and thereafter applying a base color to obtain a printed effect without the use of steam.

As we pointed out in our aforesaid copending application Ser. No. 585,439 entitled Method And Apparatus For Finishing Pile Fabric, until sometime in the late 1960's carpet was dyed by dipping a fixed length thereof into a large dye vat and oscillating the carpet back and forth a number of times. The dye in the vat was heated and the dye was fixed on the carpet while in the vat. The carpet was thereafter washed and dried before continuing the production process. Since this vat dyeing process resulted in an inefficient arresting of the carpet production a dye process was developed which permitted continuous lengths of carpet to be passed through dyeing and printing apparatus. However, in the practice of this process, which has been in existence now for some 17 years, large steamers had to be inserted after the dyeing process to heat the carpet and dye to a sufficient temperature in the presence of sufficient moisture to cause fixation of the dye onto the carpet. Because of the enormous length of the steamers required and the enormous amounts of energy utilized by the steamers the cost of dyeing carpet increased substantially as the cost of energy rose.

In our aforesaid patent application Ser. No. 585,439 a method and apparatus is disclosed for dyeing and fixing a continuously moving web of carpet as the carpet is being dyed by dispensing a heated liquid dye onto the carpet at a temperature sufficient to fix the dye in the carpet material. The dyeing and fixing of the dye is accomplished by heating the dye prior to dispensing it onto the moving carpet, the temperature of the dye being sufficiently high to provide substantially instant fixation of the dye, and by continuously recirculating the dye through the distribution manifolds and back to the dye tank a uniform coloration across the carpet is obtained. By eliminating the need for the steamer previously used, the dye production line is substantially shortened while enormous reductions in energy utilization are attainable.

Inasmuch as solid color carpet comprises only a portion of the overall carpet market, and the process described in our aforesaid patent application Ser. No. 585,439 applies a single color to the carpet, the desirability of producing dyed carpet having a printed look without the necessity of a steamer for fixing the dye is readily apparent. In the prior art various colors have been sprayed onto a carpet having the base color dye prior to fixation by a means of steam in the steamer. However, the novel process described in our aforesaid patent application Ser. No. 585,439 eliminated the need for a steamer for solid color carpets and the advantages would be dissipated if a steamer is utilized for fixing the additional dyes subsequently applied for purposes of attaining a printed look.

In our U.S. application Ser. No. 608,944 we disclosed and claimed a method for dyeing a continuously moving web of pile fabric in which a heated liquid dye is applied to the web at a first station and thereafter liquified dyes of various colors are individually applied to the web at respective subsequent stations while the web is still at a sufficiently high temperature so that the dyes are set while on the web. Now, upon further development and experimentation, it surprisingly has been found that similar results may be obtained by reversing the direction in which the web is moving, i.e., the liquified dyes are individually applied to the web and thereafter the heated liquid dye is applied to set all the dyes.

SUMMARY OF THE INVENTION

Consequently, it is a primary object of the present invention to provide a method for dyeing a continuous moving web of pile fabric with a base color dye and applying dyes of other colors to the web to provide a printed affect and fixing the dyes without the use of a steamer, the base color being applied before or after the other colors.

It is another object of the present invention to provide a method of dyeing a moving web of carpet by wetting the web with a heated liquid dye to provide a base color and spraying liquified dye onto the wet web either after the heated liquid base color dye is applied and while the web remains heated by the heated liquid dye or before the heated liquid base color dye has been applied so that the liquified dyes are heated by the base color dye, and in either case the dyes are set by the heat of the base color dye.

It is a further object of the present invention to provide a method of dyeing a moving web of carpet to provide a base color with a patterned affect having at least one other color thereon, the method including wetting the carpet with a dye of the base color heated to a temperature sufficient to fix the dye in the web material, and spraying dyes of the other colors individually onto the web, the spraying of the other colors occurring either while the temperature of the web remains sufficiently high as a result of initially wetting the carpet with the base color dye, or the spraying of the other colors occurring initially and the temperature of the web and the dyes thereon being heated by the base color dye so as to fix the other dyes in the carpet material in either case.

Accordingly, the present invention provides a method in which a heated wetting solution is applied onto a moving web of textile material, the solution which preferably is a dye, is applied at a temperature sufficient to provide substantially instant fixation thereof so as to provide a base color to the web, and spraying at least one and preferably several separate liquified dyes of different colors onto the web either after the base color and before permitting the temperature of the web to drop substantially, or before the base color so as to heat the web and the liquified dyes, whereby not only is the base color fixed, but also the dyes of the other colors are fixed by the temperature of the moving web.

The dye which provides the base color is heated and applied to the web which, in the specific application of the invention, is carpet, in a manner similar to that disclosed in our prior aforesaid patent application Ser. No. 585,439. The patterning colors are sprayed onto the carpet in seriatim at room temperature, the spraying stations being spaced apart and, at least in the case where the patterning colors are sprayed subsequent to the base color, being in close proximity to the location at which the base color dye is applied so that the temperature of the web does not drop substantially below the temperature required for the dye fixation. In the case where the patterning colors are sprayed prior to the base color, the temperature and the wetting of the carpet by the base color dye ensures dye fixation of all the dyes.

In the preferred form of the invention the hot base dye is applied at approximately 185° F. to 205° F., but the hotter the dye the quicker it will undergo fixation. Excellent results are obtained when the hot base color dye is applied with approximately a 200 percent to 300 percent wet pick-up, i.e., the weight of dye applied is 2 to 3 times the weight of the carpet. Each pattern color is applied with a small wet pick-up compared to that of the base color. For example, when three pattern colors are applied the wet pick-up of each is in the order of 40 percent, e.g. 120 percent total wet pick-up for all these colors. The temperature of the carpet at the time the pattern dyes are applied if subsequent to the hot base dye, ideally is in the range of at least approximately 165° F. to 175° F.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
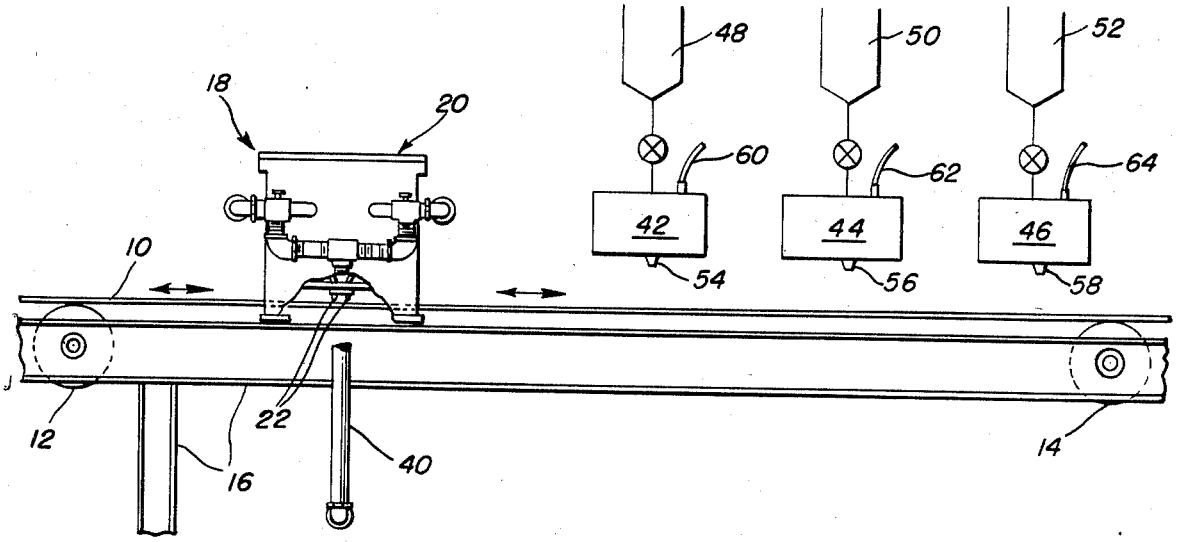
FIG. 1 is a side elevational view in diagramatic form of apparatus utilized in the practice of the process incorporating the principles of the present invention.
Figure 2:
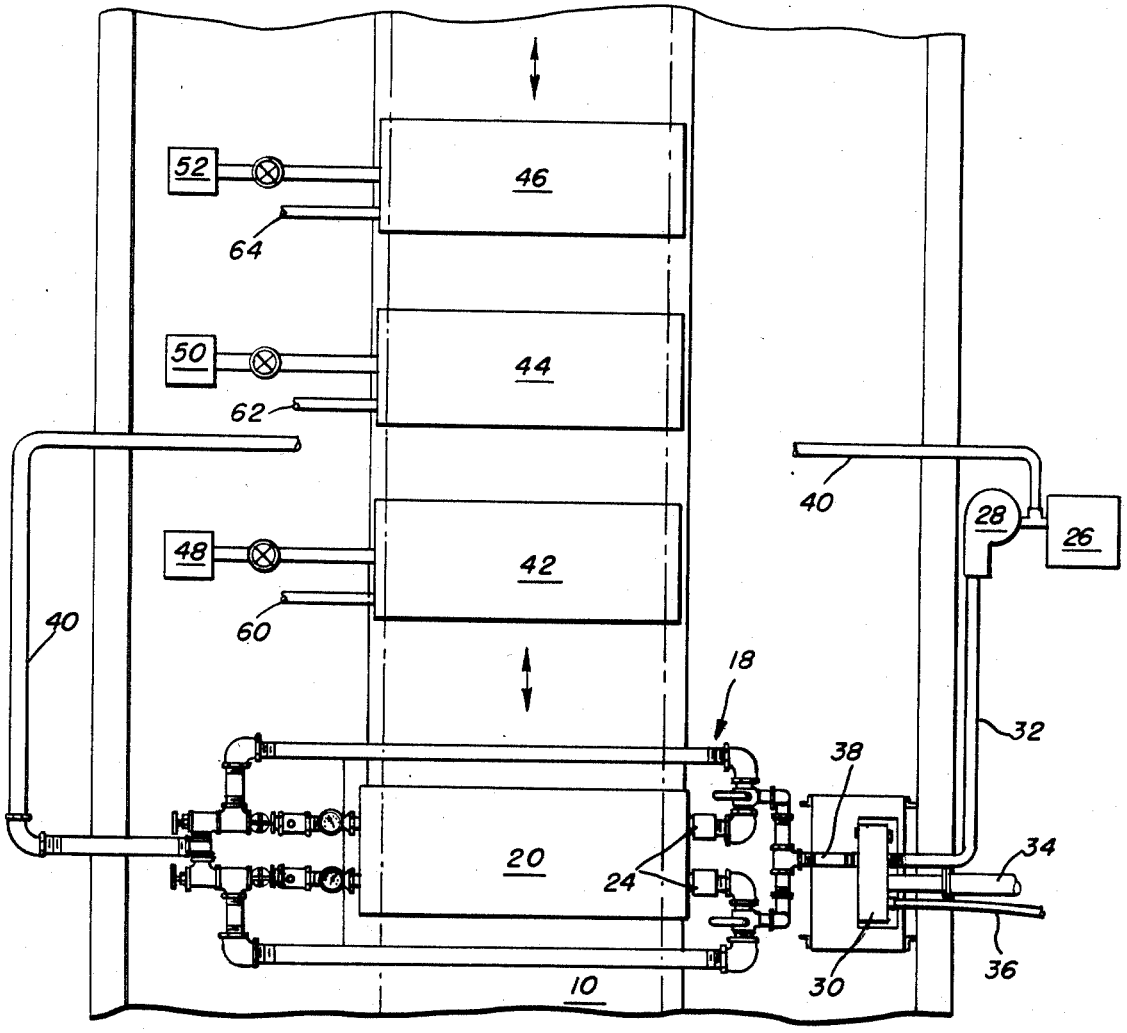
FIG. 2 is a diagramatic top plan view illustrating the process of FIG. 1 including portions of the hot dye system.

Referring now to the drawings the method of the present invention will be described in conjunction with apparatus for dyeing a moving web of carpet 10. The carpet is moved by feeding apparatus including rollers 12, 14 over a frame 16 passing firstly or lastly beneath the wetting spray of a hot dye station 18, the dye being sprayed onto the carpet at a temperature of approximately 185° F. to 205° F.

The dye station 18 includes a dye applicator 20 and associated dye heating apparatus such as disclosed in our aforesaid copending U.S. application Ser. No. 585,439. Thus, the dye applicator includes a series of nozzles 22 (only one pair being illustrated in the drawings) extending transversely across the width of the carpet which is fed with hot dye from at least one and preferably two manifolds 24, which may or may not be mixed with air to obtain a foaming action. The dye is supplied from a tank 26 to a pump 28 where it is pumped to a heat exchanger 30 through an inlet conduit 32. The dye is heated by exchange of heat with a heating medium such as steam supplied to an inlet 34 of the heat exchanger and exits as a condensate through an outlet 36. The heated dye exits the heat exchanger through an outlet 38 at a temperature such that the temperature in the dye applicator manifolds preferably is in the order of approximately 208° F. to 220° F. The hot dye exits the heat exchanger outlet 38 and enters the dye applicator manifolds 24 and that which is not sprayed onto the carpet is returned through piping 40 to the tank 26 and/or the pump 28.

The dye sprayed onto the carpet 10 by the applicator 20 is a solid color which provides a base color to the carpet. The amount of dye to thoroughly color the carpet is ideally in the range of approximately 200 percent to 300 percent wet pick-up, i.e., the weight of dye is two to three times the weight of the carpet. The carpet must be thoroughly wet and should remain at a relatively high temperature when the subsequent step of the process is the spraying of pattern color dyes.

In one preferred process at least one and preferably three other dye applicators 42,44,46 are disposed downstream of the hot dye applicator 20, preferably in the order of 12 inches therefrom. The number of such applicators depends upon the printed affect to be obtained so that more than three such applicators are conceivable, but probably not desirable. If more than one such applicator is utilized ideally it appears that they should be spaced about 36 inches apart. The dye is received by each applicator 42, 44, 46 from a respective tank 48, 50, 52, each storing a single color dye at room temperature. Each applicator may be, and preferably is, a jet foam applicator such as that disclosed in copending U.S. patent applications Ser. Nos. 391,468 filed June 23, 1982, and now U.S. Pat. No. 4,501,035, and 469,643 filed Feb. 25, 1983, and now U.S. Pat. No. 4,485,508 by Billy J. Otting one of the coinventors of the present invention and assigned to the common assignee thereof. Thus, each applicator 42, 44, 46 includes a transverse series of nozzles 54, 56, 58 (only a single one of each being illustrated) which sprays aerated foam dye onto the carpet, the air being supplied under pressure through piping 60, 62, 64 respectively.

The first ambient room temperature applicator 42 should spray its dye onto the carpet while the carpet is at the high end of the temperature range of 165° F. to 175° F. and each succeeding dye sprayed thereon preferably strikes the carpet while the carpet is in this temperature range. The principle is that each dye strikes the carpet while the carpet is still hot enough for the dye to set. As was disclosed in detail in our aforesaid copending application Ser. No. 585,439 the hot dye sets substantially instantly. Now we have developed a patterning process where room temperature color dyes are subsequently sprayed onto the carpet while the latter is hot and these room temperature dyes are set also substantially on contact with the carpet in the process so far described in which the carpet first passes the dye station 18 and then the dye applicators 42, 44, 46.

In the other preferred form of the process the ambient room temperature applicators 42, 44, 46 are arranged to spray their respective dye color onto the carpet 10 prior to the application of the hot dye from the applicator 20. Thus, this aspect of the invention is the reverse of the process described above. Effectively the direction the carpet moves over the frame 16 is reversed so that the applicator 46 first sprays dye of a single color onto the carpet web and lastly the hot dye applicator sprays the heated base color dye. If additional pattern colors are desired then after being sprayed by the applicator 46, the carpet is thereafter sprayed by room temperature applicator 44 and then applicator 42 prior to entering the hot dye station 18. The room temperature dyes on the carpet remain unfixed until the high temperature base dye of applicator 20 is applied, at which time all the dyes are set substantially on contact by the hot dye.

Excellent results have been found when the amount of dye sprayed onto carpet wetted by 200 to 300 percent wet pick-up of hot dye is approximately 40 percent wet pick-up for each color when three colors are applied, i.e., 120 percent wet pick-up for all three. Thus, it appears that 120 percent wet pick-up of ambient temperature dye subsequent to or prior to the application of the hot dye may be ideal. The pH of all the dyes should be in the range of approximately three to six.

It will be obvious to those skilled in the art that many variations may be made in the embodiments chosen for purposes of illustrating the invention. For example, since the room temperature dyes are set when contacting carpet heated by hot dye, they will also set when contacting carpet or other web material wetted by any hot liquid. However, all such modifications which do not depart from the spirit of the invention are intended to be included within the scope of the appended claims.

Having thus set forth the nature of the invention, what is claimed herein is:

1. A method of dyeing a moving web of pile fabric material comprising, spraying at least one liquid dye of a first color onto the web, and heating the liquid dye by wetting the web with a heated liquid dye of a second color while the liquified dye is on the web, said heated liquid dye being applied to said web by spraying thereon.

2. The method as recited in claim 1, wherein the heated liquid dye is applied to the web prior to the liquified dye.

3. The method as recited in claim 2, wherein the weight of the heated liquid dye applied to said web comrpises approximately two to three times the weight of said web.

4. The method as recited in claim 2, wherein the temperature of said heated liquid dye applied to said web is at least approximately 180° F. to 205° F.

5. The method as recited in claim 1, wherein the heated liquid dye is applied to the web subsequent to the liquified dye.

6. The method as recited in claim 5, wherein the weight of said heated liquid dye applied onto said web comprises approximately two to three times the weight of said web.

7. The method as recited in claim 5, wherein the temperature of said heated liquid dye applied to said web is at least 180° F. to 205° F.

8. A method of dyeing a moving web of pile fabric material comprising:

a. spraying a first liquid dye of a first color onto the web at a first station;

b. heating an additional liquid dye of a different color than said first color;

c. spraying the additional liquid dye onto the web and the first liquid dye at a wetting station to heat and set the first liquid dye on the web, the weight of the heated liquid being greater than the weight of the web.

9. The method as recited in claim 8, wherein said wetting of the web comprises applying a heated liquid dye onto said web.

10. The method as recited in claim 9, wherein said web comprises carpet.

11. The method as recited in claim 10, wherein the weight of said heated liquid dye applied onto said carpet comprises approximately two to three times the weight of said carpet.

12. The method as recited in claim 11, wherein said heated dye is sprayed onto said carpet.

13. The method as recited in claim 12, wherein the temperature of said heated liquid dye applied to said carpet is at least approximately 180° F. to 205° F.

14. The method as recited in claim 13, wherein the temperature of the liquid dye is substantially ambient temperature.

15. The method as recited in claim 10, wherein the temperature of said heated liquid dye applied to said carpet is at least approximately 180° F. to 205° F.

16. The method as recited in claim 15, wherein the weight of said heated liquid dye applied onto said carpet comprises approximately two to three times the weight of said carpet.

17. The method as recited in claim 15, wherein the temperature of the liquified dye is substantially ambient temperature.

18. The method as recited in claim 17, wherein said liquified dye is sprayed onto the carpet at more than one station spaced upstream from the wetting station.

19. The method as recited in claim 18, wherein said heated dye comprises a first color defined as a base color, and wherein each prior station for spraying liquified dye sprays a different color dye onto the carpet.

20. The method as recited in claim 17, wherein the weight of the heated liquid dye applied onto said carpet comprises approximately two to three times the weight of said carpet.

21. The method as recited in claim 20, wherein the total weight of said liquified dye is substantially less than the weight of said heated dye.

22. The method as recited in claim 21, wherein there are three liquified dye stations spaced from the wetting stations, each liquified dye station spraying dye equal in weight to approximately 40% of the weight of said carpet.

* * * * *